US011975234B2

(12) United States Patent
Yeuroukis

(10) Patent No.: US 11,975,234 B2
(45) Date of Patent: May 7, 2024

(54) PERSONAL ACTIVITY MAT

(71) Applicant: Jenifer Yeuroukis, Los Angeles, CA (US)

(72) Inventor: Jenifer Yeuroukis, Los Angeles, CA (US)

( * ) Notice: Subject to any disclaimer, the term of this patent is extended or adjusted under 35 U.S.C. 154(b) by 410 days.

(21) Appl. No.: 17/352,869

(22) Filed: Jun. 21, 2021

(65) Prior Publication Data

US 2022/0401792 A1 Dec. 22, 2022

(51) Int. Cl.

| | |
|---|---|
| ***A63B 21/00*** | (2006.01) |
| ***A47G 9/06*** | (2006.01) |
| ***A47G 27/02*** | (2006.01) |
| ***A63B 6/00*** | (2006.01) |

(52) U.S. Cl.

CPC ..... *A63B 21/4037* (2015.10); *A47G 27/0212* (2013.01); *A63B 21/4033* (2015.10); *A47G 9/06* (2013.01); *A63B 6/00* (2013.01); *A63B 2210/54* (2013.01)

(58) Field of Classification Search

CPC ... A63B 21/4037; A63B 21/4033; A63B 6/00; A47G 9/06; A47G 9/062; A47G 27/0212; A47G 27/0231; A47G 27/0237

USPC ..... 5/417, 420; 482/142, 148

See application file for complete search history.

(56) References Cited

U.S. PATENT DOCUMENTS

| | | | | |
|---|---|---|---|---|
| 4,967,986 | A * | 11/1990 | Schildkraut | A45C 11/26 383/30 |
| 5,697,874 | A | 12/1997 | Abelbeck | |
| 5,935,049 | A | 8/1999 | Hamm | |
| 6,322,485 | B1 * | 11/2001 | Marrero | A63B 21/4037 482/142 |
| 6,640,359 | B1 * | 11/2003 | Alane | A47G 27/0237 5/420 |
| 7,007,322 | B2 * | 3/2006 | Alane | A47G 27/0237 5/417 |
| 7,041,040 | B2 | 5/2006 | Dovner et al. | |
| 8,075,464 | B2 | 12/2011 | Hayes et al. | |
| 8,864,637 | B2 | 10/2014 | Leirer | |
| 9,192,801 | B1 | 11/2015 | Gouloubev | |
| 9,283,427 | B2 | 3/2016 | Palmer | |
| 10,576,351 | B2 * | 3/2020 | Ramaswamy | A63B 6/00 |
| 10,610,728 | B2 * | 4/2020 | Fano | A63B 21/0557 |
| 10,653,915 | B2 | 5/2020 | Moss | |

(Continued)

FOREIGN PATENT DOCUMENTS

CN 107441681 A 12/2017

OTHER PUBLICATIONS

"Pilates Stick", https://www.google.com/search?q=mari+windsor+pilates+mat&biw, available prior to Jun. 21, 2021 (1 page).

(Continued)

*Primary Examiner* — Robert G Santos

(74) *Attorney, Agent, or Firm* — Neal, Gerber & Eisenberg LLP

(57) ABSTRACT

A personal activity exercise mat including a base, a first handle connected to the base, a second handle connected to the base, a first equipment connector connected to the base, a second equipment connector connected to the base, a first elastic band connected to the base, and a second elastic band connected to the base, wherein these components facilitate use of the personal activity mat for multiple different activities.

14 Claims, 4 Drawing Sheets

(56) References Cited

U.S. PATENT DOCUMENTS

| | | | | |
|---|---|---|---|---|
| 10,843,026 | B2 | 11/2020 | Davis | |
| 10,843,034 | B2 | 11/2020 | Griggs | |
| 2004/0088788 | A1* | 5/2004 | Alane | A47G 27/0237 5/420 |
| 2010/0197471 | A1* | 8/2010 | Hayes | A63B 23/0211 482/142 |
| 2016/0262561 | A1* | 9/2016 | Pearce | B32B 3/266 |
| 2018/0178058 | A1* | 6/2018 | Fano | A63B 21/4023 |
| 2019/0126121 | A1* | 5/2019 | Ramaswamy | A63B 71/0036 |
| 2022/0401792 | A1* | 12/2022 | Yeuroukis | A63B 21/4033 |

OTHER PUBLICATIONS

"SPRI Hanging Mats", Located at: https://www.spri.com/products/07-70612_2?variant=33948636752&gclid=CjwKCAjw3MSHBhB3EiwAxcaEu2HtlipkbgpaJnB7hWY6w1YVrcFIJKzCFvcSCbbFEh972ZdqJhJnCxoClgsQAvD_BwE, available prior to Jun. 21, 2021 (5 pages).

"Thera-Band Exercise Station", https://www.allegromedical.com/exercise-fitness-c523/thera-band-exercise-station-p566398.html, available prior to Jun. 21, 2021 (1 page).

* cited by examiner

PERSONAL ACTIVITY MAT

BACKGROUND

Various exercise mats are known. There is a continuing need to develop mats that are more likely to be used by people for various activities (such as exercising), and that better facilitate such activities.

BRIEF SUMMARY

Various embodiments of the present disclosure provide a personal activity mat that is useable in multiple different manners.

In various embodiments of the present disclosure, the personal activity mat includes a base, a first handle connected to the base, a second handle connected to the base, a first equipment connector connected to the base, a second equipment connector connected to the base, a first elastic band connected to the base, and a second elastic band connected to the base. The arrangement of these components enable multiple different uses of the personal activity mat of the present disclosure such as discussed herein.

Other objects, features, and advantages of the present disclosure will be apparent from the following detailed disclosure and accompanying drawings.

BRIEF DESCRIPTION OF THE SEVERAL FIGURES

DETAILED DESCRIPTION

Figure 1:
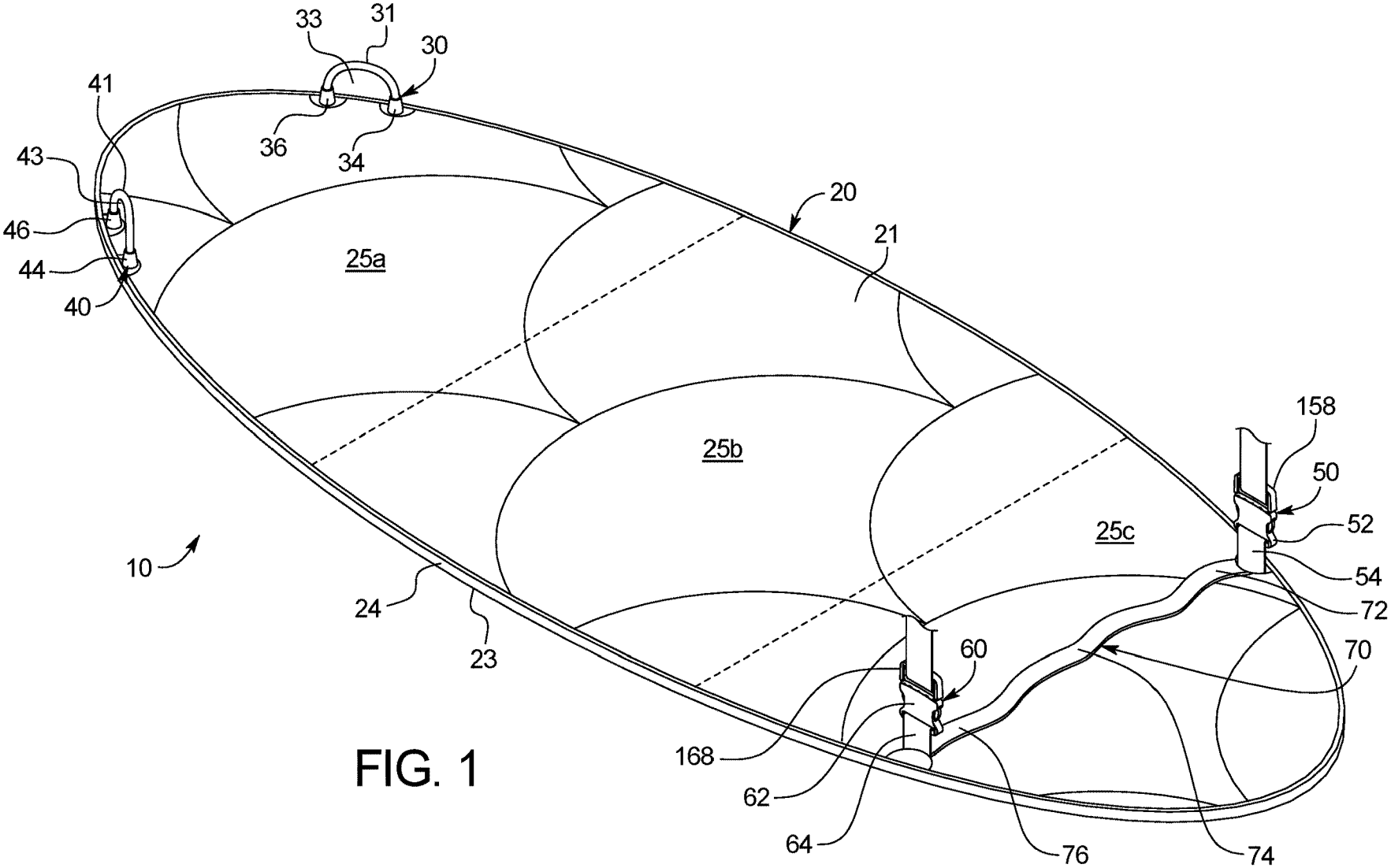
FIG. 1 is a top perspective view of a personal activity mat of one example embodiment of the present disclosure, and showing fragmentary sections of attachments strap of a piece of equipment attached to the personal activity mat.
Figure 2:
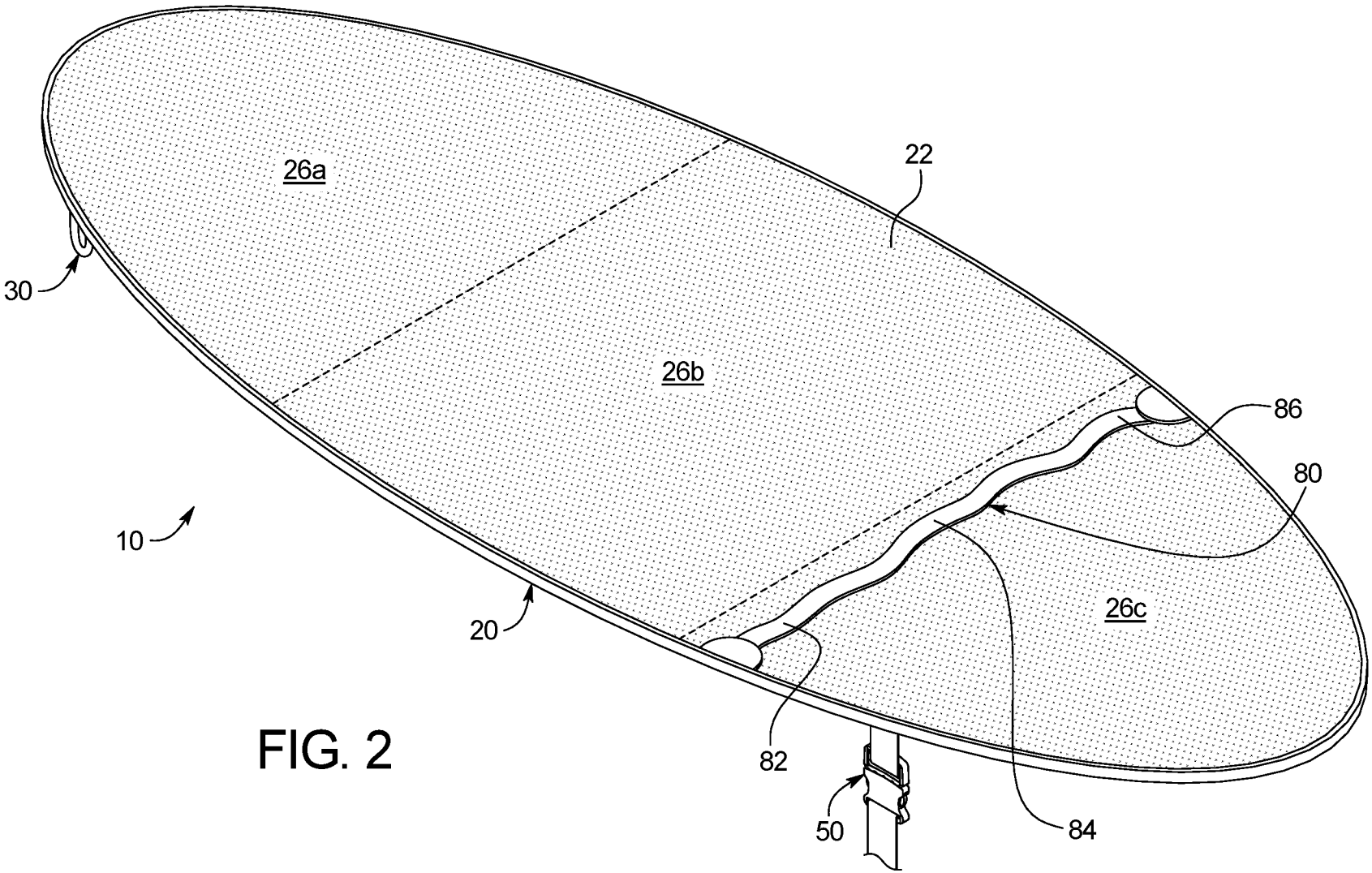
FIG. 2 is a bottom perspective view of the personal activity mat of FIG. 1.
Figure 3:
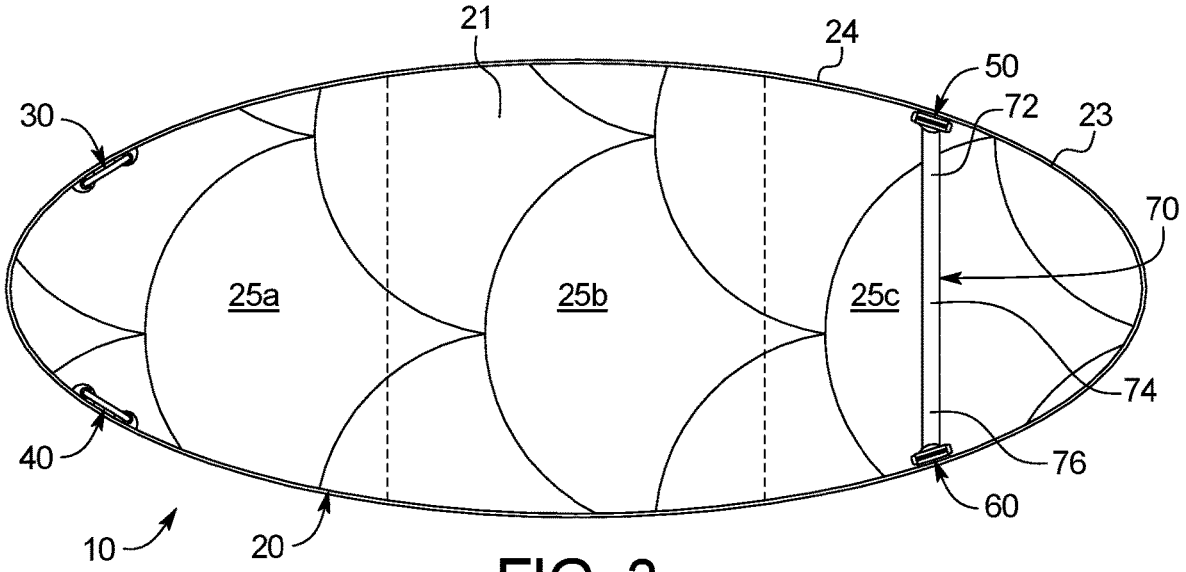
FIG. 3 is a top view of the personal activity mat of FIG. 1.
Figure 4:
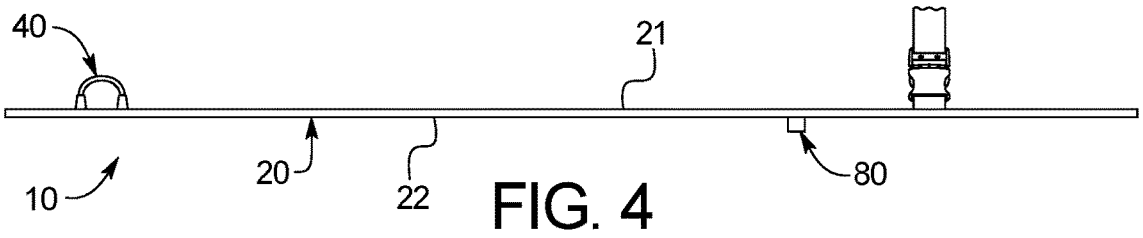
FIG. 4 is a side view of the personal activity mat of FIG. 1.
Figure 5:
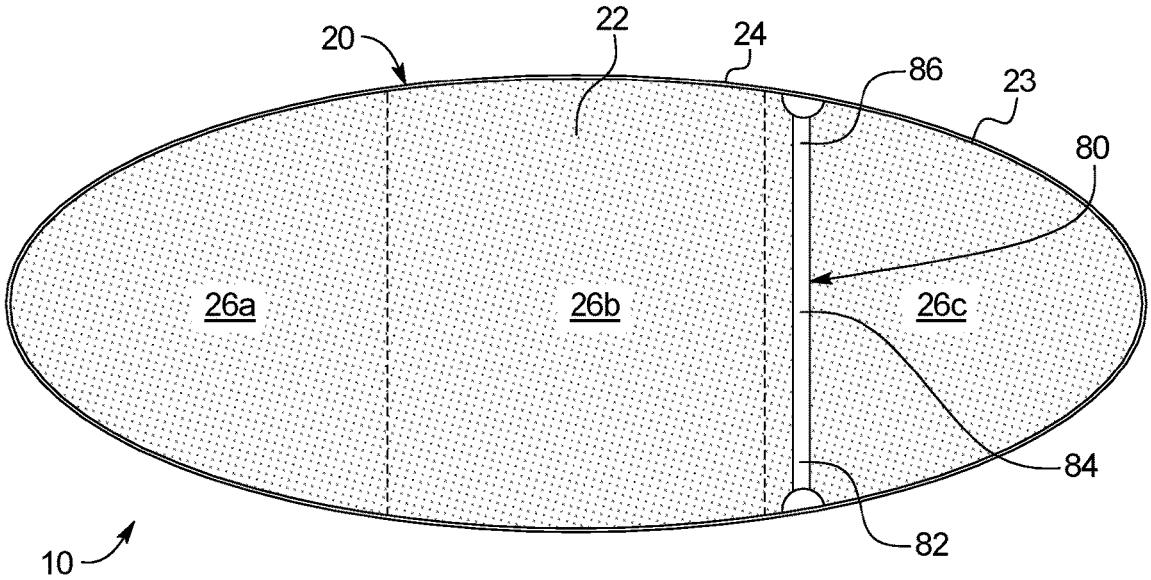
FIG. 5 is a bottom view of the personal activity mat of FIG. 1.

While the apparatus, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIGS. 1, 2, 3, 4, 5, and 6 illustrate a personal activity mat of one example embodiment of the present disclosure. This illustrated personal activity mat is generally indicated by numeral 10. The personal activity mat 10 may sometimes be referred to herein as the "mat" for brevity. The personal activity mat 10 is configured to be used by a person for various different physical activities such as further discussed below. It should be appreciated that for the purpose of the present disclosure, activities are meant to include, but are not limited to: exercises, stretching, strength training, resistance training, yoga, Pilates, Gyrotonics, physical therapy flexion, extension movements of the spine, fitness or physical therapy (such as rehabilitative physical therapy), and activities that requires support when the coordination of spine mobility and abdominal contraction are performed in the supine position.

The personal activity mat 10 is formed from a plurality of suitable fabrics and plastic components in this illustrated example embodiment as further described below. It should be appreciated that the personal activity mat of the present disclosure can be formed other suitable materials and/or combinations of materials in accordance with the present disclosure. It should also be appreciated that the configuration, size, and shape of the mat and various components of the and mat may vary in accordance with the present disclosure.

In this illustrated example embodiment, the personal activity mat 10 includes: (1) a base 20; (2) a first handle 30 suitably fixedly connected to the base 20; (3) a second handle 40 suitably fixedly connected to the base 20; (4) a first equipment connector 50 suitably fixedly connected to the base 20; (5) a second equipment connector 60 suitably fixedly connected to the base 20; (6) a first elastic band 70 suitably fixedly connected to the base 20; and (7) a second elastic band 80 suitably fixedly connected to the base 20.

In this illustrated example embodiment, the base 20 is generally oval and is formed from a plurality of fabrics. The base 20 can include any suitable quantity of layers and can include a suitable filler such as a suitable cushioning material. While flexible, the base 20 can include a suitable stabilizer that provides a desired level of rigidity and tensile strength. The base 20 has a top surface 21 and a bottom surface 22. The top surface 21 of the base 20 is relatively soft and configured for the user to sit on, lay on, kneel on, or stand on. The bottom surface 22 includes a slip resistant material (such as a silicone dot slip resistant fabric) configured to engage a floor on which the mat 10 is placed and to inhibit the mat 10 from moving on the floor. In certain embodiments, the base 20 is 68-72 inches long (at its longest area—from the topmost edge to the bottommost edge), 24 inches wide (at its widest area—which is at the center in this example), and tapered to 20 inches wide at the top and bottom section.

The base 20 includes an oval outer rim 23 that provides an outer edge 24 and that extends over the top surface 21 and the bottom surface 22. The fabric that functions as the oval outer rim 23 overlaps and is suitably fixedly connected to the top surface 21 and the bottom surface 22 for the entire oval base 20. This outer rim 23 can be otherwise formed and connected. The oval base 20 thus has opposite side with a first curvature and opposite ends with second different curvatures.

The base 20 has a first or upper section (not labeled), a second or intermediate section (not labeled), and a third or lower section (not labeled). Correspondingly, the top surface 21 of the base 20 has an first or upper section 25A, a second or intermediate section 25B, and a third or lower section 25C. Likewise, the bottom surface 22 of the base 20 has an first or upper section 26A, a second or intermediate section 26B, and a third or lower section 26C. These respective sections are generally indicated by the respective transversely extending dotted lines, but it should be appreciated that the respective dividing lines between these sections may vary in accordance with the present disclosure.

In this illustrated example embodiment, the first handle 30 and the second handle 40 are each formed from a plurality of plastic materials. These handles 30 and 40 can include any suitable material. While flexible, the handles 30 and 40 can include a suitable stabilizer that provides a desired level of rigidity and tensile strength to the handles 30 and 40. In this illustrated example embodiment, the first handle 30 and the second handle 40 are symmetrically arranged on spaced apart on opposite sides of the upper area of the upper section of the base 20 of the activity mat 10. The first and second handles 30 and 40 each extend transversely, outwardly, and upwardly from the top surface 21 of the base 10. It should be appreciated that the quantity, positions, configurations, sizes, and angles of the handles may vary in accordance with the present disclosure.

In this illustrated example embodiment, the first handle 30 includes a gripping member 31, a first connector 34 at a first end of the gripping member 31, and a second connector 36 at an opposite second end of the gripping member 31. The handle 30 and the base 20 define an opening 33 configured such that a person can insert their hand through the opening to grip the gripping member 31 of the handle 30. The first connector 34 is suitably connected to the top surface 21 of the base 20 and to the base 20. Likewise, the second connector 36 is suitably fixedly connected to the top surface 21 of the base 20 and to the base 20. The connectors 34 and 36 are connected to base 20 in such a manner that pulling on the handle 30 will result in pulling on the base 20.

Likewise, in this illustrated example embodiment, the second handle 40 includes a gripping member 41, a first connector 44 at a first end of the gripping member 41, and a second connector 46 at an opposite second end of the gripping member 41. The handle 40 and the base 20 define an opening 43 configured such that a person can insert their hand through the opening to grip the gripping member 41 of the handle 40. The first connector 44 is suitably connected to the top surface 21 of the base 20 and to the base 20. Likewise, the second connector 46 is suitably fixedly connected to the top surface 21 of the base 20 and to the base 20. The connectors 44 and 46 are connected to base 20 in such a manner that pulling on the handle 40 will result in pulling on the base 20.

In this illustrated example embodiment, the first equipment connector 50 and the second equipment connector 60 are each formed from a plurality of plastic and fabric materials. These connectors 50 and 60 can include any suitable materials. While partly flexible, the connectors 50 and 60 include a rigid portion as further described below. It should be appreciated that the quantity, positions, configurations, sizes, and angles of the equipment connectors may vary in accordance with the present disclosure.

In this illustrated example embodiment, the first and second equipment connectors 50 and 60 are arranged symmetrically spaced apart on opposite sides of the middle area of the lower section of the base 20 of the activity mat 10. The first and second equipment connectors 50 and 60 each extend transversely, outwardly, and upwardly from the top surface 21 of the base 10. It should be appreciated that the quantity, positions, configurations, sizes, and angles of the equipment connectors may vary in accordance with the present disclosure.

In this illustrated example embodiment, the first equipment connector 50 includes a clip receiver 52 configured to be coupled to (such as receiving) a clip 158 of a suitable piece of equipment (not shown), and a flexible clip receiver attacher 54. The attacher 54 is suitably connected at a first end to the clip receiver 52 and suitably fixedly connected at a second end to the base 20. The flexible clip receiver attacher 54 enables the clip receiver 52 to be positioned at different angles relative to the base 20. The clip receiver 52 is configured to be releasably connected to a clip (such as clip 158) connected of a piece of equipment (not shown).

Likewise, in this illustrated example embodiment, the second equipment connector 60 includes a clip receiver 62 configured to be coupled to (such as receiving) a clip 168 of the piece of equipment (not shown), and a flexible clip receiver attacher 64. The attacher 64 is suitably connected at a first end to the clip receiver 62 and suitably fixedly connected at a second end to the base 20. The flexible clip receiver attacher 64 enables the clip receiver 62 to be positioned at different angles relative to the base 20. The clip receiver 62 is configured to be releasably connected to a clip (such as clip 168) connected of a piece of equipment (not shown). The equipment connector 60 is suitably fixedly connected to the top surface 21 of the base 20 and to the base 20 such that in such a manner that pulling on the equipment connector 50 will result in pulling on the base 20.

It should be appreciated that the first and second equipment connector can be other suitable forms (such as clasps or seat belt type connectors) based on the equipment needs.

It should be appreciated that the piece(s) of equipment with clips 158 and 168 can be a single piece of equipment (such as an exercise bar) or can be multiple separate pieces of equipment (such as separate stretchable exercise bands).

In this illustrated example embodiment, the first elastic band 70 and the second elastic band 80 are each formed from a plurality of rubber and fabric materials, and particularly each one includes an inner rubber band and outer fabric covering. These elastic bands 70 and 80 can include any suitable materials. While flexible, the rubber materials of the bands 70 and 80 are suitably strong to provide a desired level of stretchability, rigidity, and tensile strength to the elastic bands 70 and 80. In this illustrated example embodiment, the elastic bands 70 and 80 are arranged asymmetrically on the opposite top and bottom surfaces of the base 20 of the activity mat 10. The first and second bands 70 and 80 each extend relatively close to the respective top and bottom surfaces 21 and 22 of the base 20, and are respectively stretchable away from the respective top and bottom surfaces 21 and 22 of the base 20. It should be appreciated that the quantity, positions, configurations, sizes, and angles of these elastic bands may vary in accordance with the present disclosure.

In this illustrated example embodiment, the first elastic band 70 includes a first end portion 72, a center portion 74, and a second end portion 76. The center portion 74 extends between the first end portion 72 and the second end portion 76. The first end portion 72 is suitably fixedly connected to the top surface 21 of the base 20 and to the base 20. The second end portion 76 is suitably fixedly connected to the top surface 21 of the base 20 and to the base 20. The first elastic band extends between the first equipment connector 50 and the second equipment connector 60. The first elastic band 70 and the top surface 21 of the base 20 define a space therebetween that is configured such that a person can insert their hands or feet in the space, and such that their hands or feet extending in the space engage the top surface 21 of the base 20 and are engaged by the first elastic band 70. Thus, this first elastic band 70 can be used for various activities by the user such as described below. For example, this first elastic band 70 can be used for palpate foot and leg muscles and to anchor the mat for certain activities by the user.

Figure 6:
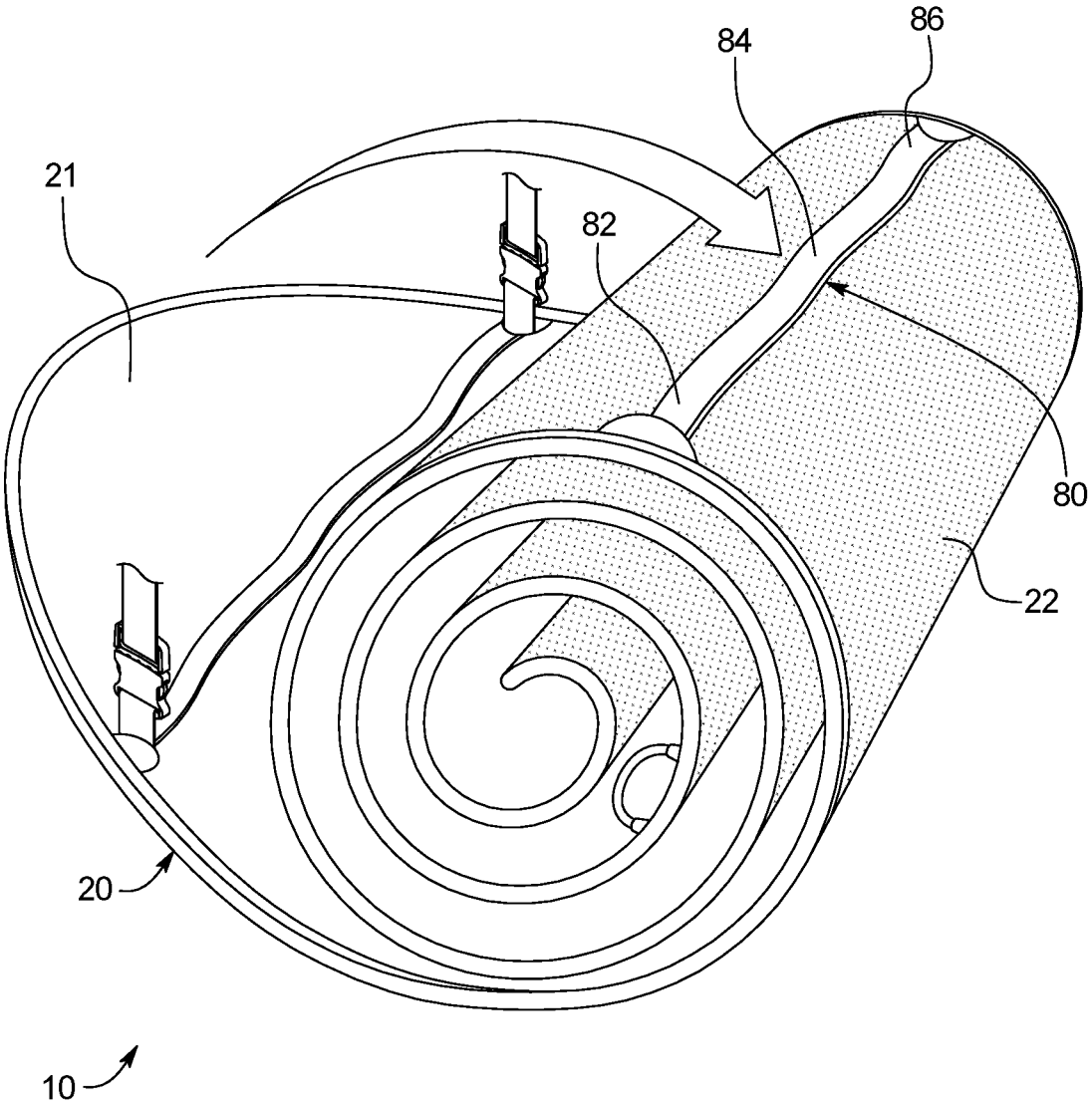
FIG. 6 is side perspective view of the personal activity mat of FIG. 1, with the personal activity mat shown partially rolled up for storage and/or transport.

In this illustrated example embodiment, the second elastic band 80 includes a first end portion 82, a center portion 84, and a second end portion 86. The center portion 84 extends between the first end portion 82 and the second end portion 86. The first end portion 82 is suitably fixedly connected to the bottom surface 22 of the base 20 and to the base 20. The second end portion 86 is suitably fixedly connected to the bottom surface 21 of the base 20 and to the base 20. The first elastic band 80 and bottom surface 22 of the base 20 define a space configured such that a portion of the upper section of the base 20 can be inserted in the space when the base 20 is rolled up such as shown in FIG. 6 and such that such portion extend in the space and engage the bottom surface 21 of the base 20 and is engaged by the second elastic band 80. In this rolled up position, the second elastic band 80 keeps the mat 10 and particularly the base 20 in that position until the bottom end is removed from being under the elastic band 80. In this example embodiment, the elastic band is positioned at the upper end of the third or lower section 26C of the bottom surface 22 of the base 20. Thus, the elastic band 80 is positioned adjacent to the second or intermediate section 26B.

As mentioned above, the personal activity mat 10 is configured to be used by a person for various of different physical activities. Certain examples of these activities are provided below. These examples are not meant to be limiting.

A first example activity using the personal activity mat 10 is for a user to exercise abdominal muscles. For such activity, the activity mat 10 is placed on a substate such as a floor with the top surface 21 facing upwardly, and the user lays on the top surface 21 of the base 20 face up and with their head on the upper section 25A between the handles 30 and 40. The user grips the handles 30 and 40 with the user's hands. The user can then perform a sit-up exercise or any other abdominal contraction exercise requiring a flexion of the spine while still gripping the handles. As the user preforms the exercise, the upper section 25A of the base 20 will remain close to the back of the user's head. The activity mat 10 will thus flexibly support the user's head and back, to partially assist the user in preforming this activity. The activity mat 10 assists the user in preforming the exercise correctly and can also help to protect the user's back and neck.

A second example activity using the personal activity mat 10 is for a user to exercise arm muscles. For such activity, the activity mat 10 is placed on a substate such as a floor with the top surface 21 facing upwardly, and the user stands on the base 20 with their feet on the lower section 25*c*. The user attaches a piece of equipment (not shown and that includes clips, bands, and handles) by attaching such clips to the clip receivers 52 and 62. The user grips the handles of the piece of equipment. The user can then perform bicep curls while still gripping the handles of the piece of equipment. As the user preforms the exercise, the weight of the user will keep the base 20 on the floor. Similar activities can be performed with user kneeling or sitting on the top surface 21 of the base 20.

A third example activity using the personal activity mat 10 is for a user to perform oblique rotations. For such activity, the activity mat 10 is placed on a substate such as a floor with the top surface 21 facing upwardly. The user attaches a piece of equipment (not shown and that includes clips, bands, and or handles) to the connectors 50 and 60. The user sits on the top surface 21 of the base 10 with the user's glute med/max facing the equipment connectors 50 and 60. The user may position their legs or ankles under the elastic band 70 for stability during the activity. The user grips the handles or closest end of the piece of equipment. The user rotates their spine away from the receivers while pulling the equipment resisting the tension to create a contraction in the torso muscles that assist in oblique contractions. The user rotates back to face the receivers and repeats the same movement the opposite direction thus engaging the other side of the torso.

A fourth example activity using the personal activity mat 10 is for a user to perform hamstring/quadriceps flexions and extensions. For such an extension and contraction activity of the hamstring and quadriceps muscles, the personal activity mat 10 is placed on a substate such as a floor with the top surface 21 facing upwardly. The user attaches separate resistance bands to each of the handles 30 and 40. The user lays on the top surface 21 of the base 20 face up and with their head on the upper section 25*a* of the base 20 between the handles 30 and 40. The user takes the bands attached to the handles 30 and 40 and attaches the opposite end of the bands to the user's corresponding ankles. The user can then perform a hamstring extension and contraction movement by extending the legs straight in the air towards the ceiling and pulling each leg downward toward the floor or bottom end of the mat. The head and torso hold the mat 10 (and particularly the upper section of the base 20) steady on the floor.

A fifth example activity using the personal activity mat 10 is for a user to perform reverse rectus abdominal contraction. For such activity, the activity mat 10 is placed on a substate such as a floor with the top surface 21 facing upwardly. The user sits in the center of the base 20 of the mat 10 on the glute med/max facing the equipment connectors 50 and 60. The user may position their legs or ankles under the elastic band 70 for stability during the exercise. The user holds handles 30 and 40 to lift the top half of the base 10 up so that it is positioned flush with their back and head in a seated upright position. The user extends their hands up with handles until full stretch and tension in the fabric of the base 20 is created. The user contracts their lower pelvic region curving the lower spine into the tense fabric. The user maintains the taught/tension by continuing to pull up on the handles 30 and 40 as they progress the pelvic contraction up into the lower abdominal region, then the middle region creating a deeper curve in the spine (wherein the tense fabric of the base 20 will support the spine as it curves). The user will roll back maintaining the tension/taught handle/base coordination 50% of the way and then return to an upright seated position. The user can progress to a rolling back until the user is laying supine on the ground if strength and desire permit.

A sixth example activity using the personal activity mat 10 is for a user to perform a forward flexion static stretch assist for the user's hips, back, and hamstrings. For such activity, the activity mat 10 is placed on a substate such as a floor with the top surface 21 facing upwardly. The user sits at the bottom third of the base 20 of the mat 10 near the elastic band 70 on their glute med/max, with legs extended forward towards the top of the base 20 of the mat 10 with the user's feet pointing towards the handles 30 and 40. The user contracts the abdominal region to bend the torso forward over their legs into a forward flexion stretch. The user may take hold of handles 30 and 40 as an anchor point to assist in stabilizing, securing and improving the stretch. If user is unable to reach the handles 30 and 40 in the above seated position, the user may adjust their position of their glute med/max to the intermediate portion or center of the base 20 of the mat 20 to adjust for lack of flexibility and then progress to the bottom third of the base 20 of the mat 10 as the flexibility allows/increases.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A personal activity mat comprising:

a base;

a first handle connected to the base;

a second handle connected to the base;

a first equipment connector connected to the base;

a second equipment connector connected to the base;

a first elastic band connected to the base and extending adjacent to a top surface of the base; and a second elastic band connected to the base and extending adjacent to a bottom surface the base, wherein the second elastic band and the bottom surface of the base define a space configured such that a portion of an upper section of the base can be inserted in the space when the base is rolled up.

2. The personal activity mat of claim 1, wherein the first handle is fixedly connected to the base at first spaced apart locations, the second handle is fixedly connected to the base at second spaced apart locations, the first equipment connector is fixedly connected to the base, the second equipment connector is fixedly connected to the base, the first elastic band is fixedly connected to the base at third spaced apart locations, and the second elastic band is fixedly connected to the base at fourth spaced apart locations.

3. The personal activity mat of claim 1, wherein the bottom surface of the base includes a slip resistant material.

4. The personal activity mat of claim 1, wherein the first equipment connector includes a first clip receiver configured to receive a first clip of a first piece of equipment and a first flexible clip receiver attacher connected at a first end to the first clip receiver and fixedly connected at a second end to the base.

5. The personal activity mat of claim 1, wherein the second equipment connector includes a second clip receiver configured to receive a second clip of a second piece of equipment and a second flexible clip receiver attacher connected at a first end to the second clip receiver and fixedly connected at a second end to the base.

6. The personal activity mat of claim 1, wherein the first elastic band and the second elastic band are each formed from a plurality of rubber and fabric materials.

7. The personal activity mat of claim 1, wherein the first elastic band and the second elastic band are arranged asymmetrically along opposite top and bottom surfaces of the base.

8. The personal activity mat of claim 1, wherein the first elastic band extends between the first equipment connector and the second equipment connector.

9. The personal activity mat of claim 1, wherein the second elastic band is positioned at an upper end of a lower section of the bottom surface of the base.

10. The personal activity mat of claim 1, wherein the base is oval.

11. A personal activity mat comprising:

an oval base having a top surface and a bottom surface, the bottom surface of the base including a silicone dot slip resistant material;

a first handle connected to the base;

a second handle connected to the base;

a first equipment connector connected to the base, the first equipment connector including a first clip receiver configured to receive a first clip of a first piece of equipment and a first flexible clip receiver attacher connected at a first end to the first clip receiver and fixedly connected at a second end to the base;

a second equipment connector connected to the base, the second equipment connector including a second clip receiver configured to receive a second clip of a second piece of equipment and a second flexible clip receiver attacher connected at a first end to the second clip receiver and fixedly connected at a second end to the base;

a first elastic band connected to the base and extending adjacent to a top surface of the base, wherein the first elastic band extends between the first equipment connector and the second equipment connector; and a second elastic band connected to the base and extending adjacent to a bottom surface of the base, wherein the second elastic band and the bottom surface of the base define a space configured such that a portion of an upper section of the base can be inserted in the space when the base is rolled up.

12. The personal activity mat of claim 11, wherein the first handle is fixedly connected to the base at first spaced apart locations, the second handle is fixedly connected to the base at second spaced apart locations, the first equipment connector is fixedly connected to the base, the second equipment connector is fixedly connected to the base, the first elastic band is fixedly connected to the base at third spaced apart locations, and the second elastic band is fixedly connected to the base at fourth spaced apart locations.

13. The personal activity mat of claim 11, wherein the second elastic band is positioned at an upper end of a lower section of the bottom surface of the base.

14. A personal activity mat comprising:

a base;

a first handle connected to the base;

a second handle connected to the base;

a first equipment connector connected to the base;

a second equipment connector connected to the base;

a first elastic band connected to the base and extending adjacent to a top surface of the base; and a second elastic band connected to the base and extending adjacent to a bottom surface the base, wherein the first elastic band and the second elastic band are arranged asymmetrically along the top and bottom surfaces of the base, and wherein the top and bottom surfaces face in opposite directions.

* * * * *